United States Patent [19]

Kiefer et al.

[11] 4,183,178

[45] Jan. 15, 1980

[54] WINDOW GLASS ADJUSTING DEVICE

[75] Inventors: Edward Kiefer, 16887 Fitzgerald, Livonia, Mich. 48154; Robert B. Robertson, 18300 Parklane, Grosse Ile, both of Mich. 48138

[73] Assignee: Ford Motor Company, Dearborn, Mich.

[21] Appl. No.: 965,714

[22] Filed: Dec. 1, 1978

[51] Int. Cl.[2] ..... E05F 11/38

[52] U.S. Cl. ..... 49/375; 403/4

[58] Field of Search ..... 49/375, 374, 348–353, 49/227; 403/4, 3

[56] References Cited

U.S. PATENT DOCUMENTS

| | | | |
|---|---|---|---|
| 2,600,101 | 6/1952 | Faulhaber | 403/4 |
| 3,228,677 | 1/1966 | Martens | 49/349 X |
| 3,844,064 | 10/1974 | Yamaha et al. | 49/348 |
| 3,868,788 | 3/1975 | Podolan | 49/374 |
| 4,051,632 | 10/1977 | Fukumoto et al. | 49/375 X |

FOREIGN PATENT DOCUMENTS

| | | | |
|---|---|---|---|
| 2633969 | 2/1977 | Fed. Rep. of Germany | 49/375 |

*Primary Examiner*—Philip C. Kannan

*Attorney, Agent, or Firm*—John J. Roethel; Keith L. Zerschling

[57] ABSTRACT

A vehicle window assembly having a window panel (11) movable in spaced relationship to and along a fixed guide (24) during raising and lowering movements. Interposed between the window panel and guide rod are guide means (13 and 15) that allow quick adjustment during the assembly of the vehicle body of the position of the window panel relative to body seals around the perimeter of the window opening. This quick adjustment is achieved through resilient retainer devices (32) having ratchet action engagement with the guide means 15 that controls the lateral spacing of the window panel relative to the guide rod. After the desired spacing is achieved through the quick adjustment devices, permanent fastening devices may be tightened to complete the installation procedure.

5 Claims, 3 Drawing Figures

WINDOW GLASS ADJUSTING DEVICE

BACKGROUND OF THE INVENTION

In some automotive vehicle bodies, such as found in hardtop models in which the door window panel opening is not surrounded by a frame, the vehicle window is guided in its raising and lowering movements solely by a window regulator mechanism and a fixed guide rod, both of which are mounted within the window well formed by outer and inner panels of the door structure. When the window panel is fully raised it must meet and rest against resilient body seals mounted on the vehicle body structure framing the door opening.

In a conventional installation, a guide bracket is bolted or otherwise secured to a lower portion of the window panel. The guide bracket has upper and lower flanges that extend laterally of the plane of the window panel toward the guide rod. Mounted on the flanges are guide members that slidably engage the guide rod. The guide members are bolted to the flanges, either the flanges or guide members being provided with oversized holes or slots to permit adjustment of the window panel to be made to insure that the panel will be properly seated relative to the body seals or weather strips.

Under current in-plant procedures, during body assembly, the individual responsible for the fitting of the window panel to the door opening and the body seals must estimate the adjustment necessary to properly meet the seals. The individual then must open the partially assembled door, make the estimated adjustment, and then close the door to determine if the adjustment was proper. If the adjustment was not correct, as is often the case, the procedure must be repeated. Due to assembly line speed, however, the individual runs out of either time or patience and merely tightens down the guide member bolts without achieving an optimum fit of the window panel to the body seals. Consequently, the fits are poor and warranty problems, such as extensive wind noise and water leakage, are created.

As noted in U.S. Pat. No. 4,051,632 issued Oct. 4, 1977 to R. Fukumoto, et al. for "Window Glass Mounting Means for Automobiles", it is necessary in order to insure proper locations of the window glasses with respect to the weather sealing strips, to employ adjustment devices in the window glass guide means so that the lateral positions of the upper edges of the window glasses can be adjusted as desired. Patentee further points out that conventional adjusting mechanisms have been found disadvantageous because it is required to make adjustments at two bolt-slot connections. Fukumoto, et al. state it was an object of their invention to provide window glass mounting means with means for adjusting the lateral position of the window glass through actuation of a single screw. Even the single screw adjustment device, however, does not overcome the objection that the assembly line worker must open and close the vehicle door several times to see that a proper fit has been made, and if not made, to further adjust the actuating screw.

SUMMARY OF THE INVENTION

The present invention relates to a vehicle window assembly having a window panel movable in spaced relationship to and along a fixed guide rod during the raising and lowering movements of a window panel. A guide bracket is mounted on a lower portion of the window panel and has upper and lower flange portions extending laterally toward the guide rod. A first guide means is secured to the upper flange portion, the first guide means having a slot therein extending laterally of the window panel. A second guide means is secured to the lower flange portion and has an aperture centrally located and in alignment with the slot in the first guide means. The guide rod projects through the slot and the aperture in the respective guide means and has sliding engagement with the side walls only of the slot and with the aperture wall.

The first and second guide means coact with the guide rod to stabilize the window panel against tilting movement in the plane of the panel, as in a conventional installation. The second guide means further coacts with the guide rod to maintain the window panel in spaced relationship to the guide rod. An important feature of the present invention is that the lower flange portion of the guide bracket attached to the window panel is moveable relative to the second guide means through which the rod projects to adjust the position of the window panel relative to the guide rod. A retainer means is anchored to the lower flange portion. The retainer means and the second guide means have coacting ratchet means adapted to hold the window panel temporarily in adjusted position. A fastening means is provided for immovably securing the lower flange portion and second guide means to each other after a desired adjustment position of the window panel is achieved.

Accordingly, the present invention allows the operator of the assembly line to set the glass from the outside of the vehicle. Once the position is obtained in which the glass is properly seated against the body seals, the retainer means holds the glass in position through the ratcheting action between the retainer and second guide means. The assembly line worker would then secure the two bolts which are currently used to hold the glass in position to make the permanent installation. Or, this could be done at a point further down the assembly line by the individual responsible for trim panel installation.

DESCRIPTION OF THE DRAWING

Other advantages and features of the present invention will become more apparent as the description proceeds, reference being had to the accompanying drawing wherein.

DETAILED DESCRIPTION OF THE INVENTION

Figure 1:
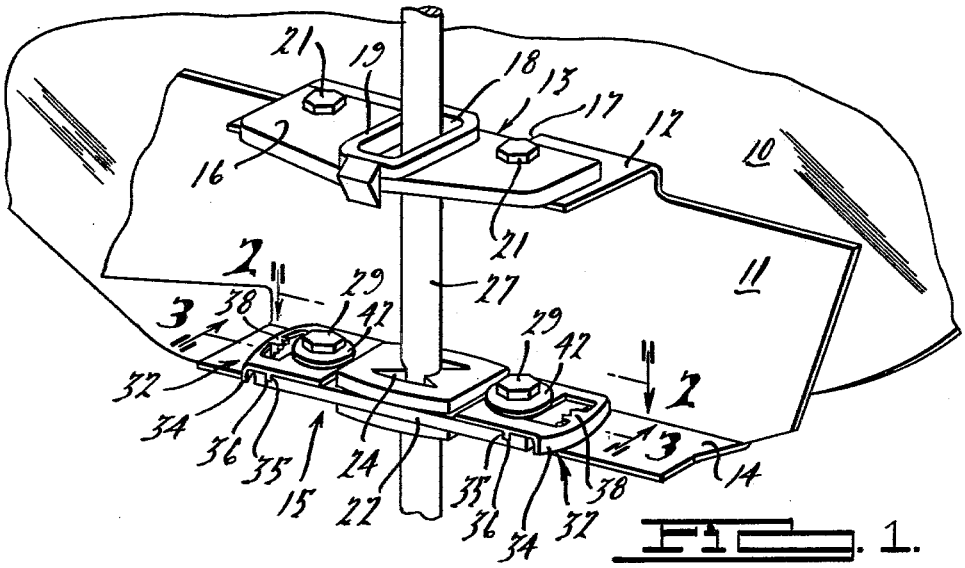
FIG. 1 is a perspective view of a window glass adjusting device embodying the present invention.

Referring now to sheet 2 of the patent drawings in U.S. Pat. No. 4,051,632 referenced in the background statement of this specification, and more particularly to FIG. 2 thereon, there is shown an automobile window glass panel adapted to be raised and lowered by a conventional single arm window regulator coupled to a channel member carried on a bracket secured to the lower edge of the glass. To stabilize the glass panel against tilting movement in its plane and also against lateral movement, the bracket is provided with upper and lower guide means slidable on a substantially vertically extending rod.

The present invention is concerned with the structure of the bracket, the guide means and the rod, and the manner in which the three coact to stabilize the glass panel against tilting in its plane and against movement laterally. More particularly, the present invention is concerned with the provision of an adjustment device for permitting rapid assembly line positioning of the glass panel relative to the fixed rod so that the panel will properly be positioned in the vehicle body or door opening to make optimum sealing contact with the elastomeric seals or weatherstrips mounted around the inner perimeter of the body or door opening. Accordingly, reference is now made to FIGS. 1-3 of the drawing accompanying this specification.

In FIG. 1, there is shown a fragmentary portion of a vehicle window panel 10 having secured thereto a bracket 11. The bracket 11 has a laterally extending upper flange 12 that carries an upper guide means, generally designated 13, and a laterally extending lower flange 14 that carries a lower guide means, generally designated 15. The upper guide means 13 is conventional and comprises an elongated flat member 16, preferably molded of plastic, that straddles a centrally positioned cut-out or notch 17 in the flange 12. The body member 16 has a centrally positioned, laterally extending slot 18 therein that is surrounded above and below the body member by a reinforcing rim or wall 19. The body member 16 is bolted by suitable bolts 21 to the upper flange portion 12.

Figure 2:
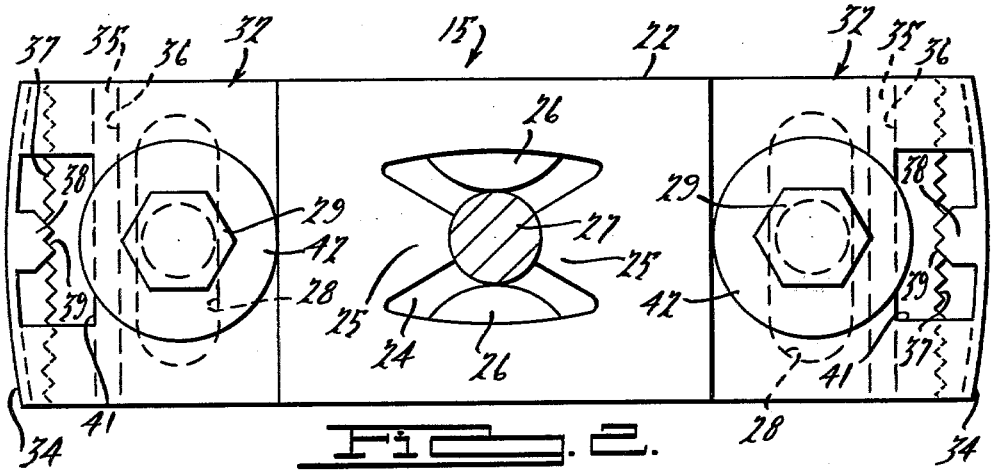
FIG. 2 is an enlarged sectional view on a line 2—2 of FIG. 1.

The lower guide means 15 is structurally more complex than the upper guide means 13. It, too, comprises a centrally reinforced body member 22 that straddles a notch 23. The body member 22 has through its centrally reinforced center portion a centrally positioned aperture 24. As best seen in FIG. 2, the aperture 24 has pairs of diametrically opposed projections 25 and 26 projecting inwardly toward its center, the projections 25 and 26 being adapted to slidably engage the guide rod 27 that guides the window panel during its upward and downward movement. The center of the aperture 24, when the lower guide means 15 is mounted on the lower flange 14, is vertically aligned with the lateral center of the slot 18 in the upper guide means 13. In the case of the upper guide means, the rod 27 is slidably engaged with the side walls of the slot 18. The slot 18 permits the guide means 15 to be moved laterally relative to the rod 27 as is necessary, for a reason to become apparent.

The lower guide means body member 22 has laterally extending slots 28 on each side of the aperture 24, the slots 28 receiving bolts 29 that project through bolt holes 31 in the flange portion 14 on each side of the notch 23.

In a conventional vehicle window assembly, the glass panel would be adjusted to fit the body seals around the window opening by a trial and error method at one station in the vehicle body assembly line. With the door closed, the individual responsible for the fit of the panel to the body seals would determine if the glass panel should be moved laterally inwardly or outwardly to provide the proper seal engagement. The individual then would have to open the door and apply lateral pressure to the panel to move it inwardly or outwardly, as required. Because of the slot 18 in the upper guide means 13, the latter is free to move relatively to the guide rod 27 with the glass panel and bracket 11. The lower guide means 15, as will be readily apparent, does not have this freedom of movement and, therefore, the lower flange 14 of the bracket 11 moves laterally with respect to the guide means 15 as permitted by the slots 28 in the guide means body member 22. The individual making the adjustment must then close the door to test the fit of the glass panel against the body seals. This operation may have to be repeated several times, if the panel fitter does not run out of patience or time, before a final setting is determined so that the bolts 29 and nuts 31 may be tightened to render the guide means 15 and flange 14 relatively immovable to one another.

Figure 3:
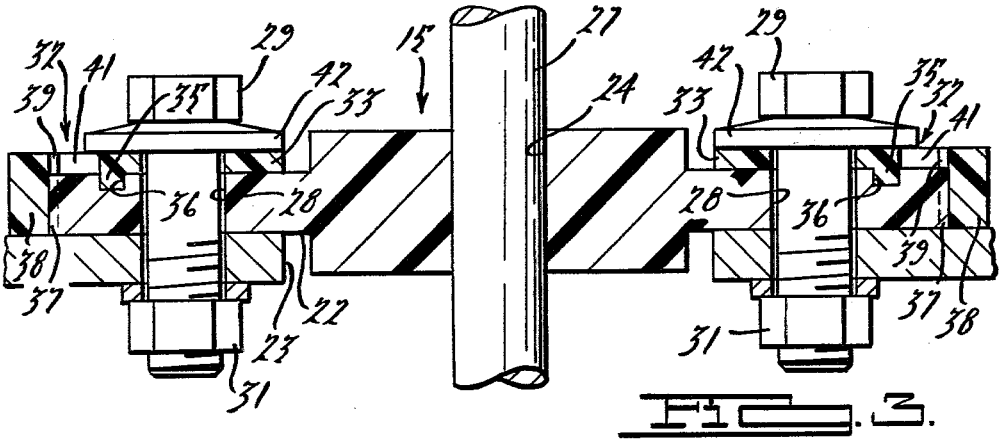
FIG. 3 is an enlarged sectional view on a line 3—3 of FIG. 1.

In the present invention, a quick adjustment device is inserted between the heads of the bolts 29 and the upper guide means 15. The quick adjustment device comprises a pair of retainer means, each generally designated 32. Each retainer means 32 is a molded resilient plastic member having a substantially flat main body portion 33 terminating in a slightly curved end flange 34. The body portion 33 is apertured to receive the bolt 29. The main body portion 33 has on its underside a downwardly projecting rib 35 extending across its lateral width. As best seen in FIG. 3, the rib 35 projects into a groove or recess 36 extending across the width of the body member 22 of the lower guide means 15. At each end the guide means body member 22 has a series of serrations or ratchet teeth 37. Integral with the curved flange 34 on the end of each retainer means 32 is a vertical rib 38 having on its surface facing the serrations or teeth 37 on the guide means body member 22 at least a couple of vertical teeth 39. Each retainer means body portion 33 has an enlarged opening 41 extending from the flange 34 wall to the rib 35 for a substantial portion of the width of body portion 33 to enhance the flexibility of the flange 34 in the area of the toothed rib 38.

A Belleville type washer 42 may be used beneath the head of the bolt 29 and the upper surface of the body portion 33 of the retainer means 32.

The quick adjustment device as described permits rapid setting of the window panel 11 against the body seals. When the vehicle body approaches the window fitters assembly line station, the bolts and nuts holding the lower guide means 15 and guide bracket lower flange 14 in assembled relation are in a loose condition. The window fitter is able to set the window panel against the body seal by merely pushing or pulling on the upper extremeties of the window panel from the outside of the vehicle. Movement of the window panel 11 and flange portion 14 relative to the guide means 15 causes the retainer means 32 above each end of guide means 15 to move laterally of the latter. This causes the teeth 39 on the retainer means flanges 34 to ratchet on the opposed serrations or teeth 37 on each end of the main body member 22 of the guide member 15. The coaction between the rib 35 on each retainer means body portion 32 with the recess 36 in the body member 22 of the guide means 15 causes the teeth 39 on the retainer means to move across the teeth 37 on body member 22 without causing the retainer means to rotate around the bolt 29. Once the desired window panel position is attained, the resilient retainer means 32 will hold the panel in the desired position. The assembly line worker then only has to secure the bolts 29 to permanently secure the guide means 15, the retainer means 32 and the lower flange 14 against movement relative to each other.

It will be understood that the invention is not to be limited to the exact construction shown and described, but that various changes and modifications may be made without departing from the spirit and scope of the invention as defined in the appended claims.

We claim:

1. In a vehicle window assembly having a window panel movable in spaced relationship to and along a fixed guide rod during raising and lowering movements of the panel, a guide bracket mounted on the window panel having upper and lower flange portions extending laterally toward the guide rod, guide means mounted on the upper and lower flange portions, respectively, of the guide bracket, one of the guide means having a slot therein extending laterally of the window panel and the other having an aperture therethrough in alignment with the slot in the one guide means, the guide rod projecting through the slot and the aperture in the respective guide means and having sliding engagement with the side walls only of the slot and with the aperture wall, the slotted and apertured guide means coacting with the guide rod to stabilize the window panel against tilting movement in the plane of the panel, the apertured guide means further coacting with the guide rod to maintain the window panel in its spaced relationship to the guide rod, the improvement comprising:

the apertured guide means being movable relative to the flange portion on which it is mounted and having ratchet engagement with resilient retainer means anchored to the same flange portion, the ratchet engagement permitting lateral adjustment of the window panel relative to the guide rod, the retainer means being operative to temporarily hold the apertured guide means and the window panel in adjusted spaced relationship, and fastening means for immovably securing the apertured guide means to the guide bracket flange portion on which it is mounted after adjustment.

2. A vehicle window assembly having a window panel movable in spaced relationship to and along a fixed guide rod during raising and lowering movements, a guide bracket mounted on a lower portion of the window panel and having upper and lower flange portions extending laterally toward the guide rod, a first guide means secured to the upper flange portion and having a slot therein extending laterally of the window panel, a second guide means secured to the lower flange portion having an aperture therethrough in alignment with the slot in the first guide means, the guide rod projecting through the slot and the aperture in the respective guide means and having sliding engagement with the side walls only of the slot and with the aperture wall, the first and second guide means coacting with the guide rod to stabilize the window panel against tilting movement in the plane of the window panel, the second guide means further coacting with the guide rod to maintain the window panel in its spaced relationship to the guide rod, the lower flange portion being movable relative to the second guide means to adjust the position of the window panel relative to the guide rod, retainer means anchored to the lower flange portion, the retainer means and second guide means having coacting ratchet means to hold the window panel temporarily in adjusted position, and fastening means immovably securing the lower flange portion and second guide means to each other after a desired adjustment position of the window panel is achieved.

3. A vehicle window assembly according to claim 2, in which:

the second guide means comprises an elongated member having its longitudinal axis substantially paralleling the plane of the window panel, the elongated member having intermediate each of its ends and the aperture a slot substantially normal to the longitudinal axis of the member, the slots coacting with the fastening means to limit the relative movement between the lower flange portion and the second guide means to movement laterally of the plane of the window panel.

4. A vehicle window assembly according to claim 3, in which:

the retainer means comprises a pair of resilient retainer members each having a serrated end portion, the second guide means elongated member having serrations at each of its ends engageable by the serrations on the resilient retainer, the resilient retainer member serrations being adapted to ratchet over the serrations on the second guide means upon lateral force being applied to the window panel.

5. A vehicle window assembly according to claim 3 or 4, in which:

the fastening means immovably securing the lower flange portion and the second guide means to each other also fixes the retainer means on the lower flange portion.

* * * * *